US005372064A

United States Patent [19]

Dubuit et al.

[11] Patent Number: 5,372,064

[45] Date of Patent: Dec. 13, 1994

[54] PRINTING ASSEMBLY FOR PRINTING MACHINES

[75] Inventors: Jean-Louis Dubuit, Paris; Bernard Hardy, Pomponne, both of France

[73] Assignee: Societe d'Exploitation des Machines Dubuit, Noisy le Grand, France

[21] Appl. No.: 910,733

[22] Filed: Jul. 8, 1992

[30] Foreign Application Priority Data

Jul. 15, 1991 [FR] France ..... 91 08873

[51] Int. Cl.[5] ..... B41F 17/08

[52] U.S. Cl. ..... 101/40; 101/124

[58] Field of Search ..... 101/35, 37, 40, 40.1, 101/DIG. 39, 124

[56] References Cited

U.S. PATENT DOCUMENTS

| | | | |
|---|---|---|---|
| 1,351,830 | 9/1920 | Bradford | 101/37 |
| 2,142,158 | 1/1939 | Sloan | 101/124 |
| 2,198,565 | 4/1940 | Schutz et al. | 101/124 |
| 2,878,620 | 1/1958 | Calehuff et al. | 101/40 |
| 3,124,065 | 3/1964 | Bozek et al. | 101/37 |
| 3,166,176 | 1/1965 | Turner | 101/40 |
| 3,251,298 | 5/1966 | Rudolph et al. | 101/40 |
| 3,269,305 | 8/1966 | Rossi | 101/35 |
| 4,498,386 | 2/1985 | Rouly et al. | 101/40 |
| 4,750,419 | 6/1988 | Meredith | 101/40 |
| 4,798,135 | 1/1989 | Meredith | 101/40 |

FOREIGN PATENT DOCUMENTS

| | | | |
|---|---|---|---|
| 0239038 | 9/1987 | European Pat. Off. . | |
| 0265982 | 5/1988 | European Pat. Off. | 101/40.1 |
| 1471925 | 12/1971 | Germany . | |

*Primary Examiner*—Edgar S. Burr
*Assistant Examiner*—Anthony H. Nguyen
*Attorney, Agent, or Firm*—Young & Thompson

[57] ABSTRACT

A printing assembly for a printing machine comprises a drum mounted for rotary movement about an axis and supporting a plurality of object holders parallel to the drum axis and uniformly circumferentially spaced around the axis. A drum drive imparts continuous rotary movement. A printing station at the periphery of drum for printing successive objects in the course of displacement by the printing station. The printing station is carried by a beam and includes a screen and squeegee. A beam drive is synchronized with the drum drive and imparts arcuate reciprocating movement to the beam about the axis such that the printing station tracks movement of an object at the printing station. The screen is disposed substantially parallel to the axis and mounted for tangential movement to the drum and the object at the printing station. A screen drive imparts rectilinear reciprocating movement to the screen relative to the beam in synchronism with beam movement.

8 Claims, 3 Drawing Sheets

PRINTING ASSEMBLY FOR PRINTING MACHINES

FIELD OF THE INVENTION

The present invention is generally concerned with printing assemblies also referred to as "impression" heads for printing machines of the kind comprising a drum rotatable about an axis and carrying a plurality of holding devices parallel to and equi-angularly distributed around said axis each adapted to hold one object to be printed and at the periphery of said drum at least one printing station adapted to operate on an object as it moves past it. One of the requirements to be met in implementing an impression head of this type is the need to achieve maximum productivity.

BACKGROUND OF THE INVENTION

At present, the printing station being fixed, the drum must be rotated stepwise so that the printing station can operate each time it stops.

Under these conditions it is very difficult to exceed throughputs of more than 3 000 to 4 000 operations per hour.

OBJECT AND SUMMARY OF THE INVENTION

A general object of the present invention is an arrangement enabling the throughput to be increased very significantly and procuring other advantages.

To be more specific, the object of the present invention is an impression head of the kind concerned characterized in that the printing station is carried by a beam which is rotatable relative thereto and associated with control means adapted to impart to the beam cyclic rotary or angular reciprocating movement about said axis.

In this way the printing station accompanies or tracks the drum as it rotates as each object is printed.

As a result the drum may rotate continuously.

The throughput can then be as high as 6 000 operations per hour.

Furthermore, it is advantageously possible to dispose around the drum, without significantly increasing its footprint and to the further benefit of productivity, a plurality of printing stations controlled synchronously, in particular where the objects concerned must be printed several times in succession.

BRIEF DESCRIPTION OF THE DRAWINGS

The features and advantages of the invention will emerge from the following description given by way of example with reference to the appended diagrammatic drawings in which.

DETAILED DESCRIPTION OF THE INVENTION

Figure 1:
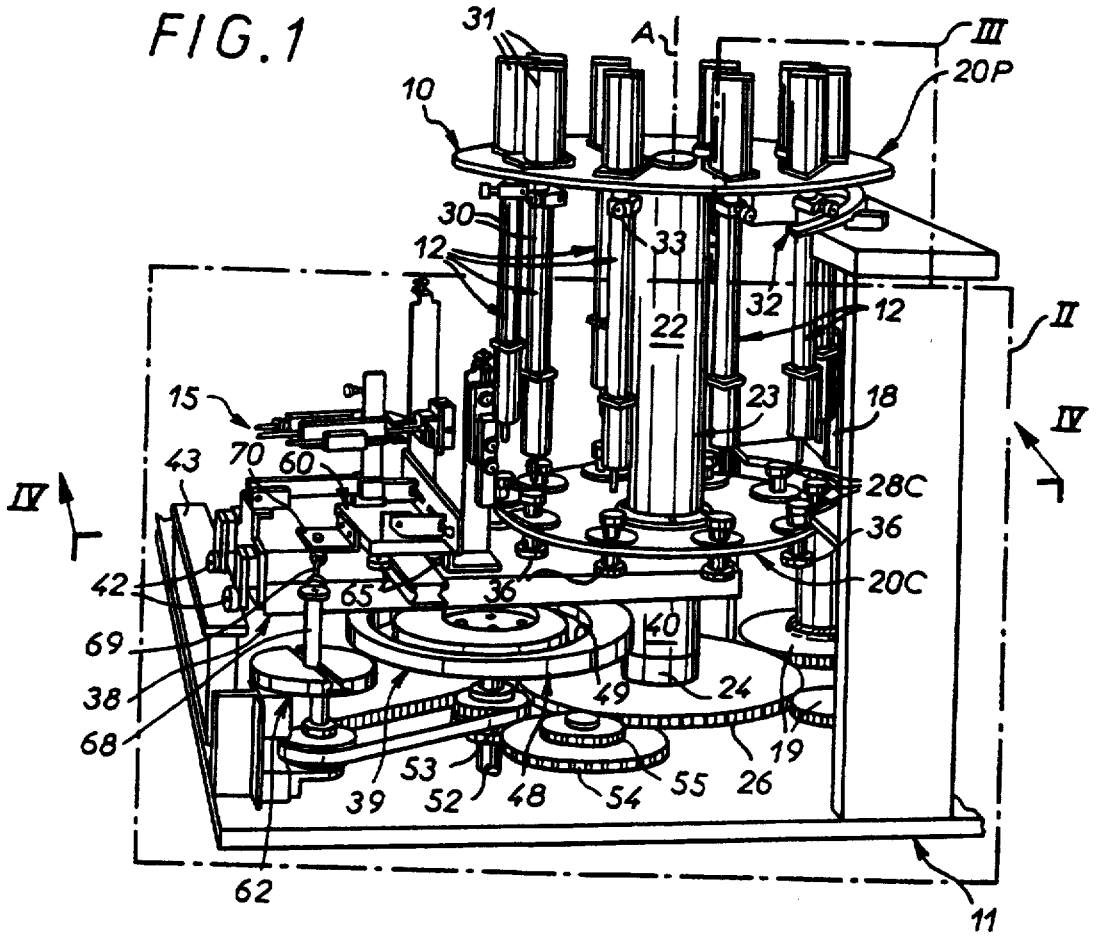
FIG. 1 is a general perspective view of an impression head in accordance with the invention.

As shown in these figures, the printing assembly or impression head in accordance with the invention comprises a drum 10 rotatable about an axis A on a frame 11 (FIG. 4) and carrying a plurality of holding devices or means 12 parallel to and equi-angularly or uniformly circumferentially spaced around said axis A, each adapted to carry an object 14, as shown diagrammatically in chain-dotted line in FIG. 6, and at the periphery of said drum 10, as will be described in more detail later, at least one printing station 15 adapted to operate on or print an object 14 as it moves past the station.

As the construction of the frame 11 will be obvious to one skilled in the art it will not be described in detail here.

Only those of its component parts necessary to explain the invention will be briefly mentioned.

In the embodiment shown the rotation axis A of the drum 10 is vertical.

The drum 10 is served by a feed and take-off conveyor to the side of which the impression head in accordance with the invention is disposed and by two transfer devices, a feed transfer device adapted to take objects to be printed from the feed and take-off conveyor and to move them successively to the location of the holding devices 12 and the other adapted to take the objects successively from the holding devices 12 after being printed and to return them to the feed and take-off conveyor, thus constituting, in combination with the impression head, a printing machine.

The feed and take-off conveyor and the transfer devices are not part of the present invention and are well known in themselves. They will not be described in detail here.

Figure 2:
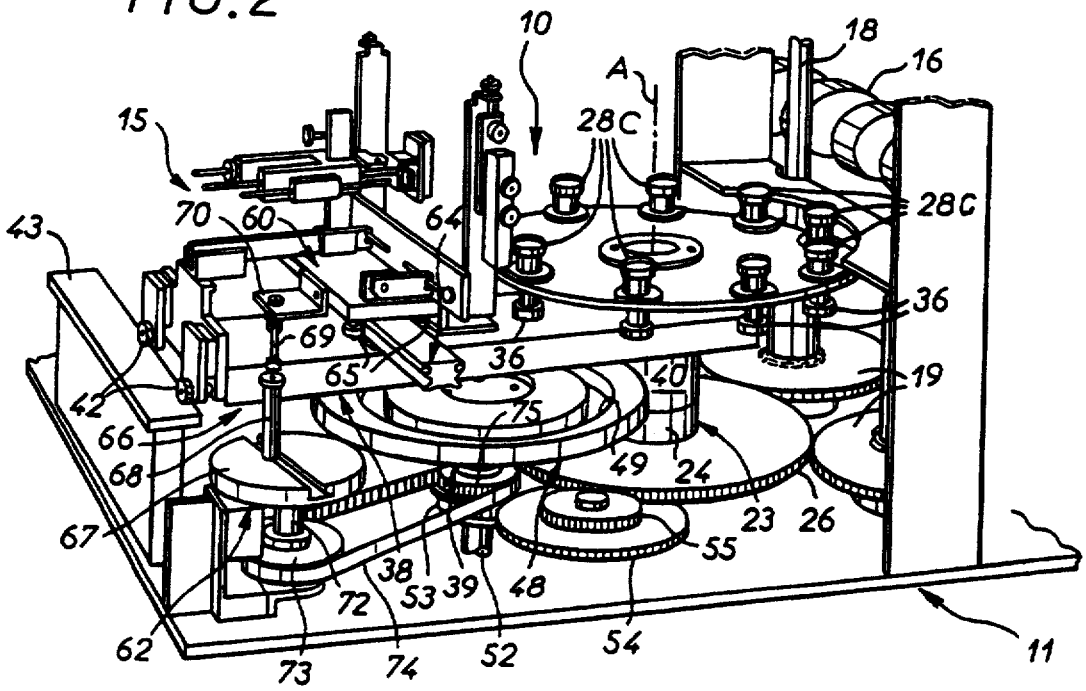
FIG. 2 shows to a slightly larger scale and with some component parts removed substantially the part of FIG. 1 identified by the box II in FIG. 1.

FIG. 2 shows only an Archimedes' screw 16 which is part of the feed and take-off conveyor and is adapted to separate the objects to be printed from each other at the location of the impression head in accordance with the invention and FIGS. 1 and 2 show only the shaft 18 of one of the transfer devices and the gears 19 driving both of them.

In the embodiment shown the drum 10 comprises spaced parallel top and bottom plates 20P, 20C between which the holding devices 12 extend and both of which have a generally circular contour. They are spaced apart by a hollow shaft 22 constituting about the axis A a first section of the shaft 23 of the drum 10.

The second section of the shaft 23 is another hollow shaft 24 constrained to rotate with the bottom plate 20C and extending below the latter around a column 25 fastened to the frame 11. A gear 26 is constrained to rotate with the base of the column 25 (see FIG. 4).

In the embodiment shown the holding devices 12 carried by the drum 10 each comprise in a manner that is known per se two members 28P, 28C parallel to the rotation axis A of the drum 10, each rotatable on the drum 10 about an axis parallel to the rotation axis A. At least one of them is mobile relative to the other parallel to the rotation axis A in order to grasp and hold an object 14 to be printed.

Member 28P, referred to hereinafter for convenience only as the point member, is carried by the top plate 20P. The member 28C, referred to hereinafter for convenience only as the cup member, is carried by the bottom plate 20C.

Member 28P, 28C need only be briefly described.

With reference to the point member 28P, suffice it to say that, carried by a rod 30 mounted to slide on the top plate 20P parallel to the rotation axis A of the drum 10, it is acted on by a spring actuator 31 urging it constantly towards the cup member 28C and that, cooperating with a cam 32 carried by the frame 11, a roller 33 keyed to the rod 30 is adapted to move it away from said cup member 28C at the location of the transfer devices operative between the drum 10 and the feed and take-off conveyor.

With reference to the cup member 28C, suffice it to say that a roller 36 is constrained to rotate with it under the bottom plate 20C of the drum 10 which carries it, for reasons that will emerge later.

The hollow shaft 22 constituting the first section of the shaft 23 of the drum 10, the top plate 20P of the latter and the point members 28P carried by the top plate 20P have been omitted from FIG. 2.

According to the invention, the printing station 15 as a whole is carried by a beam 38 extending transversely, in practice perpendicularly to the rotation axis A of the drum 10. Drive means 39 are adapted to impart to the beam 38 oscillatory angular reciprocating movement about the rotation axis A.

The beam 38 extends cantilever fashion from a hub 40 freely mounted around the shaft 23 of the drum 10. To be more specific the hollow shaft 24 constituting the section of the shaft 23 is disposed under the bottom plate 20C of the drum 10. The beam constrained to rotate with the hub 40 mounted for rotation on the hollow shafts by means of bearings. At its free end the beam 38 bears on a longitudinal member 43 (unnumbered) which is fastened to the frame 11 by means of at least one roller 42, and in practice two spaced rollers 42.

In the embodiment shown the beam 38 is a welded fabricated beam with a generally rectangular contour incorporating all necessary stiffening ribs and spacers.

Figure 4:
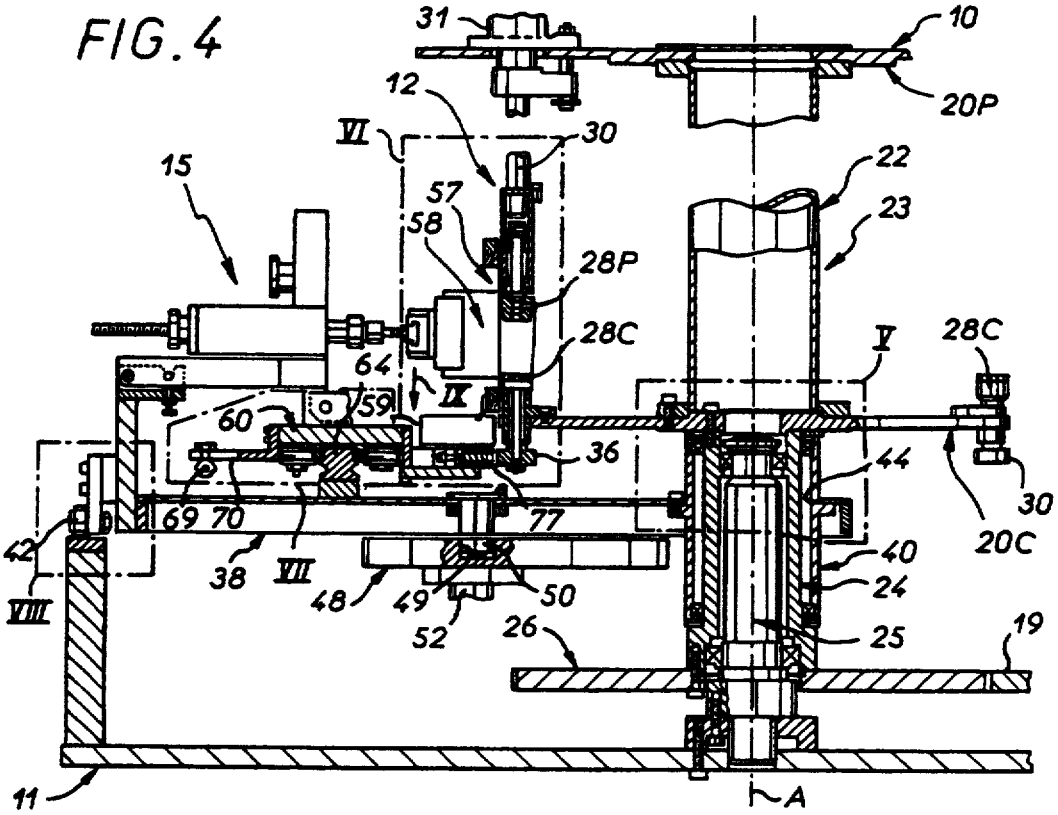
FIG. 4 is a view of the impression head in accordance with the invention in transverse cross-section substantially on the line IV—IV in FIG. 1.
Figure 5:
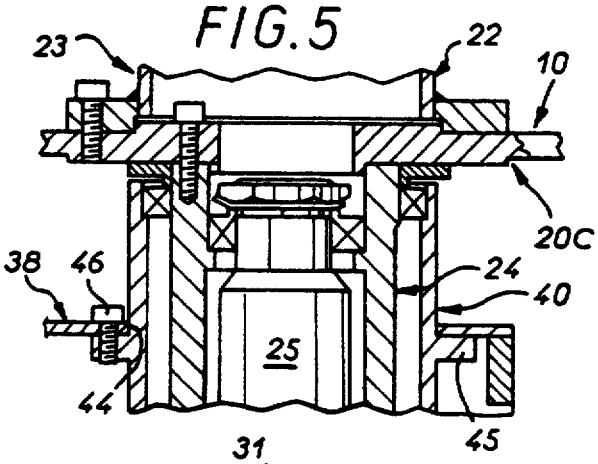
Figure 3:
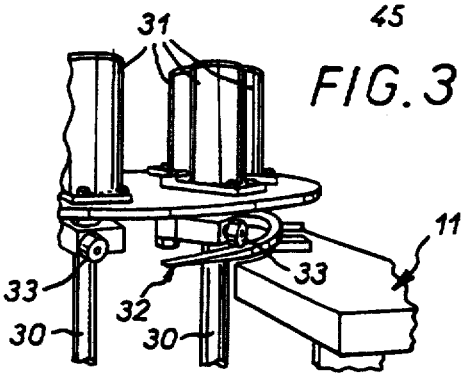
FIG. 3 shows to a slightly larger scale substantially the part of FIG. 1 identified by the box III in FIG. 1.
Figure 7:
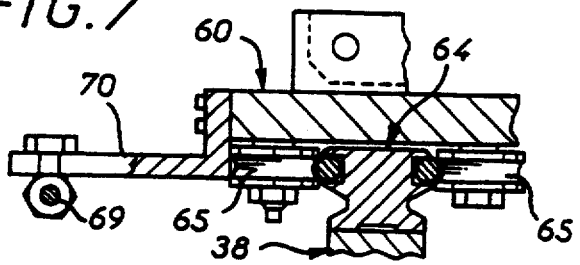
Figure 8:
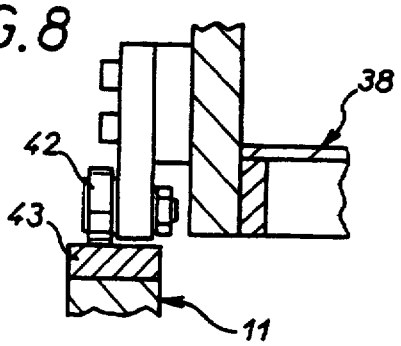

By means of a circular opening 44 beam 38 is fitted over the hub 40, bearing on a flange 45 of the hub to which it is fastened by screws 46 (FIGS. 4 and 5).

In the embodiment shown, the drive means 39 for beam 38 comprises a rotary cam 48 with a circular cam track 49 with which is engaged a roller 50 rotatably mounted on the lower surface of the beam 38 (FIGS. 1, 2 and 4).

The cam track 49 is in practice a double cam track and its rotation axis is vertical, parallel to the rotation axis A of the drum 10.

A motor-gearbox unit (not shown) is keyed to its shaft 52.

This motor-gearbox unit drives the machine continuously.

Also keyed to the shaft 52 is a gear 53 which via two gears 54, 55 providing the appropriate transmission ratio meshes with the gear 26 to which the shaft 23 of the drum 10 is keyed.

The drive means 39 for the beam 38 are therefore synchronized with the drive means of the drum 10.

The same applies to the transfer devices operative between the drum 10 and the feed and take-off conveyor, the gears 19 of these transfer devices meshing with the gear 26 of the drum 10.

Figure 6:
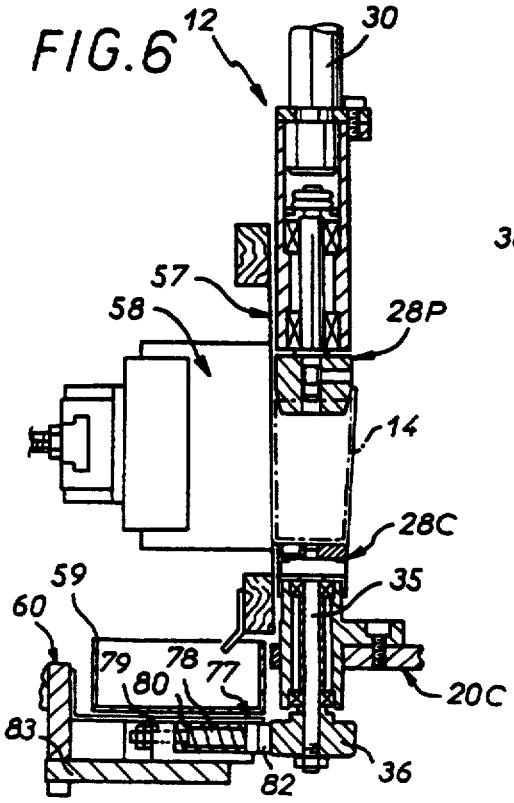
FIGS. 5, 6, 7, 8 show to a larger scale the details of FIG. 4 identified by the boxes V, VI, VII, VIII in FIG. 4.

In the embodiment shown the printing station 15 is a silkscreen printing station with a screen 57 and squeegee 58 (FIGS. 4 and 6).

Such a silkscreen printing station is known per se and need not be described in great detail here.

Suffice it to say that in the embodiment shown the screen 57 lies substantially in a vertical planar parallel to drum axis A and a trough 59 is provided at its lower end to collect the ink which flows down from its upper part.

The screen 57 and the squeegee 58 are omitted from FIGS. 1 and 2.

In accordance with the invention the screen support 60 which carries the screen 57 is movable transversely on the beam 38, tangentially to the drum 10, and has associated drive means 62 for imparting thereto rectilinear reciprocating movement relative to the beam 38.

The beam 38 carries a transverse strip member 64 with which the screen support 60 is engaged by means of rollers 65 mounted on its lower surface, which rollers rotate about axes parallel to the rotation axis A of the drum 10.

In the illustrated embodiment the drive means 62 of the screen support 60 comprise on the opposite side of the beam 38 from the drum 10 a linkage 66 with a crank 67 in the form of a rotatable plate carrying an eccentric upright 68 and a connecting rod 69 which is articulated to the upright 68 at one end and to a lug 70 fastened to the screen support 60 at its other end.

A notched pulley 73 is constrained to rotate with the shaft 72 of the handle 67 and is linked by a notched belt 74 to a notched pulley 75 constrained to rotate with the shaft 52 of the cam 48.

In this way, like the drive means 39 for the beam 38, the drive means 62 for the screen support 60 are synchronized with the drive means of the drum 10, all these drive means being coupled to the same motor-gearbox unit.

Figure 9:
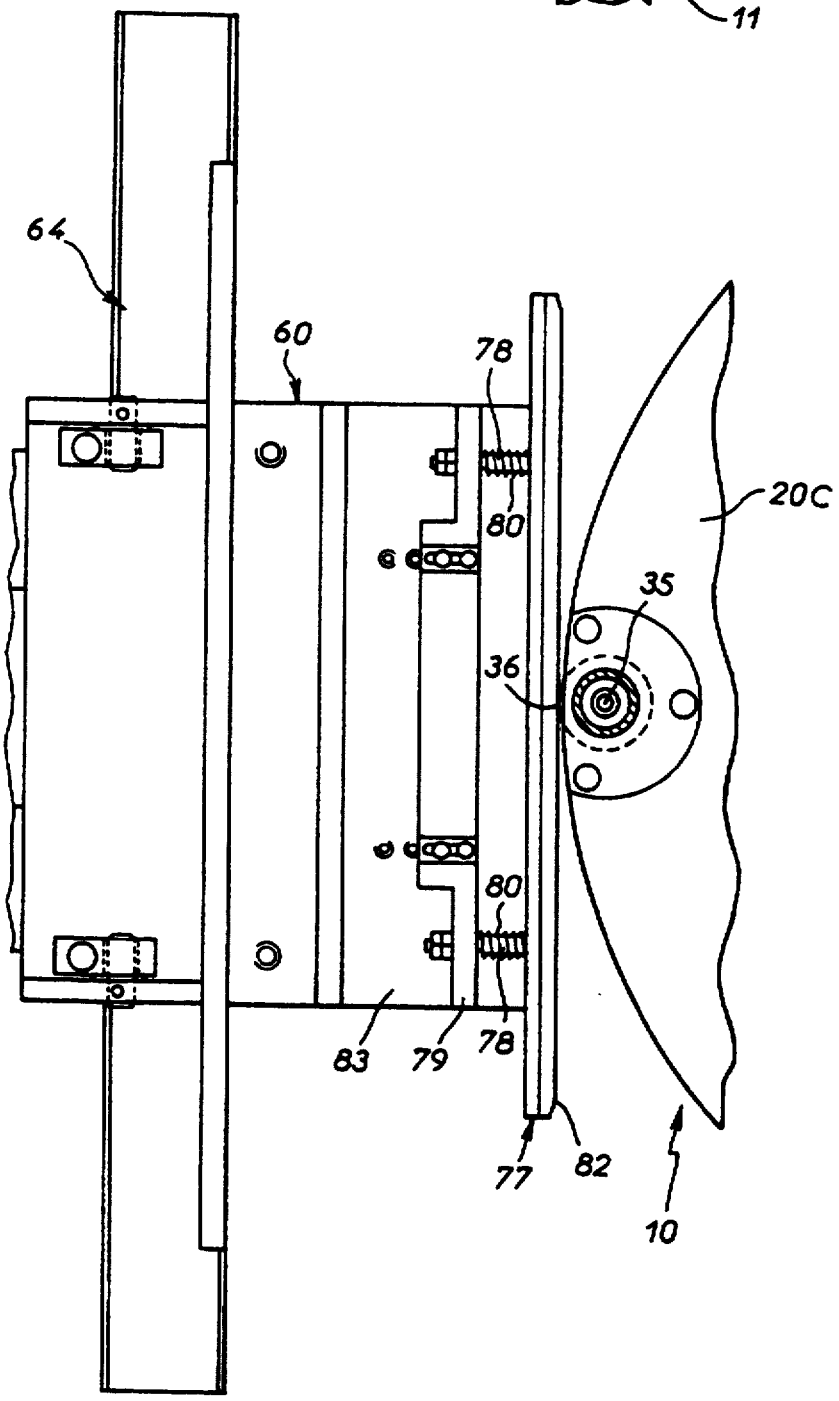
FIG. 9 shows to a larger scale and with certain component parts removed a partial plan view of the impression head in accordance with the invention as seen in the direction of the arrow IX in FIG. 1.

On the same side as the drum 10 and therefore on the side opposite the linkage 66 the screen support 60 carries a strip member 77 which is tangential to the drum 10 against which rubs, as the drum 10 rotates, the roller 36 of each holding device 12, which rather is carried by the holding device and constrained to rotate with the cup member 28C of the holding device 12 (FIGS. 4, 6 and 9).

The strip member 77 is movable on the screen support 60 against spring means which constantly urge it towards the drum 10.

In the illustrated embodiment the strip member 77 is carried by rods 78 which slide through a crossmember 79 fastened to the screen support 60. Around the rods 78, between the crossmember 79 and the strip member 77, are springs 80 constituting spring means which urge the strip member towards the drum 10. Strip member 77 carries a longitudinal friction facing 82 by which it is in driving engagement with the roller 36 of the respective holding devices 12.

In this embodiment the crossmember 79 is an angle-iron attached to a bracket 83 fastened to the screen support 60 in such a way that its position can be varied.

It is clear from the foregoing description that in operation the drum 10 is rotated continuously or non-intermittently about its rotation axis A.

Each time one of the holding devices 12 arrives at the location of the printing station 15 the beam 38 carrying the printing station 15 briefly tracks the arcuate movement of the holding device 12, in one direction before it under goes arcuate return movement in the opposite direction to meet the next object holding device 12.

The object 14 so held is therefore printed during the arcuate or circular movement in the one direction as the printing station 15 tracks the object holding device 12.

In the usual way this printing action involves tangential movement of the screen support 60 relative to the respective holding device 12 at the printing station and conjoint and synchronized rotation (by means of strip member 77 and roller 36 of the holding device 12); this tangential movement in one direction is followed by a return tangential movement in the opposite direction to printing the next object 14.

The present invention is, naturally, not limited to the embodiments described and shown but encompasses any variant execution thereof.

In particular, a plurality of printing stations 15 may be disposed circumferentially around the drum 10 and either carried by a common beam and driven by a common cam or carried by separate beams with a separate cam for each beam.

Furthermore, although in the embodiment specifically described and shown the beam employed is a straight beam transverse to the drum axis, an annular or ring beam extending circumferentially around this axis may be used instead, especially where a plurality of printing stations are required to print in a plurality of colors.

We claim:

1. Printing assembly for a printing machine of the kind comprising a drum and a plurality of object holding means supported thereby, said drum being mounted for rotary movement about an axis said object holding means being parallel to said axis and uniformly circumferentially spaced around said axis, drum drive means for imparting continuous rotary movement to said drum, at least one printing station being disposed at the periphery of said drum for printing successive objects in the course of displacement thereof by the printing station, a beam said printing station being carried by said beam and including a printing screen and a squeegee in printing relationship therewith, beam drive means, and means synchronizing said beam drive means with said drum drive means for imparting oscillatory or reciprocating arcuate movement to said beam about said axis such that said printing station is arcuately displace in the direction of rotation of the drum to print one object and then moves in an opposite or return direction to meet for printing another object, said screen being disposed substantially parallel to said axis and mounted for movement substantially tangentially to the drum and to an object located at the printing station, and screen drive means for imparting reciprocating rectilinear movement to said screen relative to said beam in synchronism with said drum drive means.

2. Printing assembly according to claim 1, wherein the beam is elongate transversely to said axis of the drum.

3. Printing assembly according to claim 2, wherein said drum drive means includes a driving shaft for driving the drum, said beam being cantilevered on a hub extending around the driving shaft for the drum, a longitudinally member carried at a free end of the beam and fastened to a fixed frame.

4. Printing assembly according to claim 1, wherein said beam drive means comprises a rotary cam with a cam track and a roller rotatably mounted on said beam and engageable with said cam track.

5. Printing assembly according to claim 1, wherein said object holding means each comprise axially facing members both rotatably mounted on said drum and at least one said facing members being mobile relative to the other in a direction parallel to said drum axis, each of said holding means having a roller constrained to rotate with one of its opposed facing members, and a screen support supporting said screen and a strip member carried by said screen support and disposed tangentially to said drum, said strip member being in frictional contact with said roller in the course of displacement of the said object holding means by said printing station.

6. Printing assembly according to claim 5, wherein said strip member is movably mounted on said screen support against spring means urging said strip member towards said drum.

7. Printing assembly according to claim 1, wherein said holding means are rotatably mounted on said drum, and means for rotating said holding means in synchronism with screen movement tangentially to said drum.

8. Printing assembly according to claim 1, wherein said axis of rotation is vertical.

* * * * *